US010106347B2

(12) United States Patent
Lin

(10) Patent No.: US 10,106,347 B2
(45) Date of Patent: Oct. 23, 2018

(54) FEEDING MECHANISM

(71) Applicant: AVISION INC., Hsinchu (TW)

(72) Inventor: Chia-Ching Lin, Taichung (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/727,736

(22) Filed: Oct. 9, 2017

(65) Prior Publication Data

US 2018/0179002 A1 Jun. 28, 2018

(30) Foreign Application Priority Data

Dec. 27, 2016 (TW) ..... 105143438 A

(51) Int. Cl.
*B65H 3/06* (2006.01)
*B65H 7/20* (2006.01)

(52) U.S. Cl.
CPC ..... *B65H 3/063* (2013.01); *B65H 7/20* (2013.01); *B65H 2601/255* (2013.01); *B65H 2801/39* (2013.01)

(58) Field of Classification Search
CPC . B65H 3/063; B65H 7/20; B65H 3/34; B65H 3/52; B65H 3/5246; B65H 3/5276; B65H 3/54; B65H 2601/255; B65H 2801/39
See application file for complete search history.

(56) References Cited

U.S. PATENT DOCUMENTS 4,418,904 A * 12/1983 Fujimoto ..... B65H 1/06 271/116
9,580,260 B2 2/2017 Cheng et al.

FOREIGN PATENT DOCUMENTS

TW M318011 U 9/2007
TW 1560128 B 12/2016

* cited by examiner

*Primary Examiner* — David H Bollinger

(57) ABSTRACT

A feeding mechanism comprises a base body, a feeding roller and a linkage assembly. The base body has a feeding channel. The feeding roller is disposed on the base body, and a part of the feeding roller is located in the feeding channel. The linkage assembly comprises a guiding component and a pressing component. The guiding component is pivotally coupled to the base body. Two ends of the pressing component are respectively and slidably disposed on the base body and the guiding component. The guiding component is rotatable relative to the base body so as to drive the pressing component to move along an extension direction of the feeding channel relative to the guiding component.

8 Claims, 4 Drawing Sheets

FEEDING MECHANISM

CROSS-REFERENCE TO RELATED APPLICATIONS

This non-provisional application claims priority under 35 U.S.C. § 119(a) on Patent Application No(s). 105143438 filed in Taiwan, R.O.C. on Dec. 27, 2016, the entire contents of which are hereby incorporated by reference.

TECHNICAL FIELD

The disclosure relates to a feeding mechanism, more particularly to a feeding mechanism having a linkage assembly.

BACKGROUND

In the past, the data and documents were preserved in physical form. Nowadays, in the digital era, data and documents can be preserved through digitalization so as to save the physical space that is used to preserve the physical data and documents.

Physical data and documents can be digitized to digital files by being scanned by a scanner. Since automatic scanners had been invented, an automatic scanner capable of automatically feeding and discharging scanning material makes scanning more efficient.

SUMMARY

One embodiment of the disclosure provides a feeding mechanism including a base body, a feeding roller and a linkage assembly. The base body has a feeding channel. The feeding roller is disposed on the base body, and a part of the feeding roller is located in the feeding channel. The linkage assembly includes a guiding component and a pressing component. The guiding component is pivotally coupled to the base body. Two ends of the pressing component are respectively and slidably disposed on the base body and the guiding component. The guiding component is rotatable relative to the base body so as to drive the pressing component to move along an extension direction of the feeding channel relative to the guiding component.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
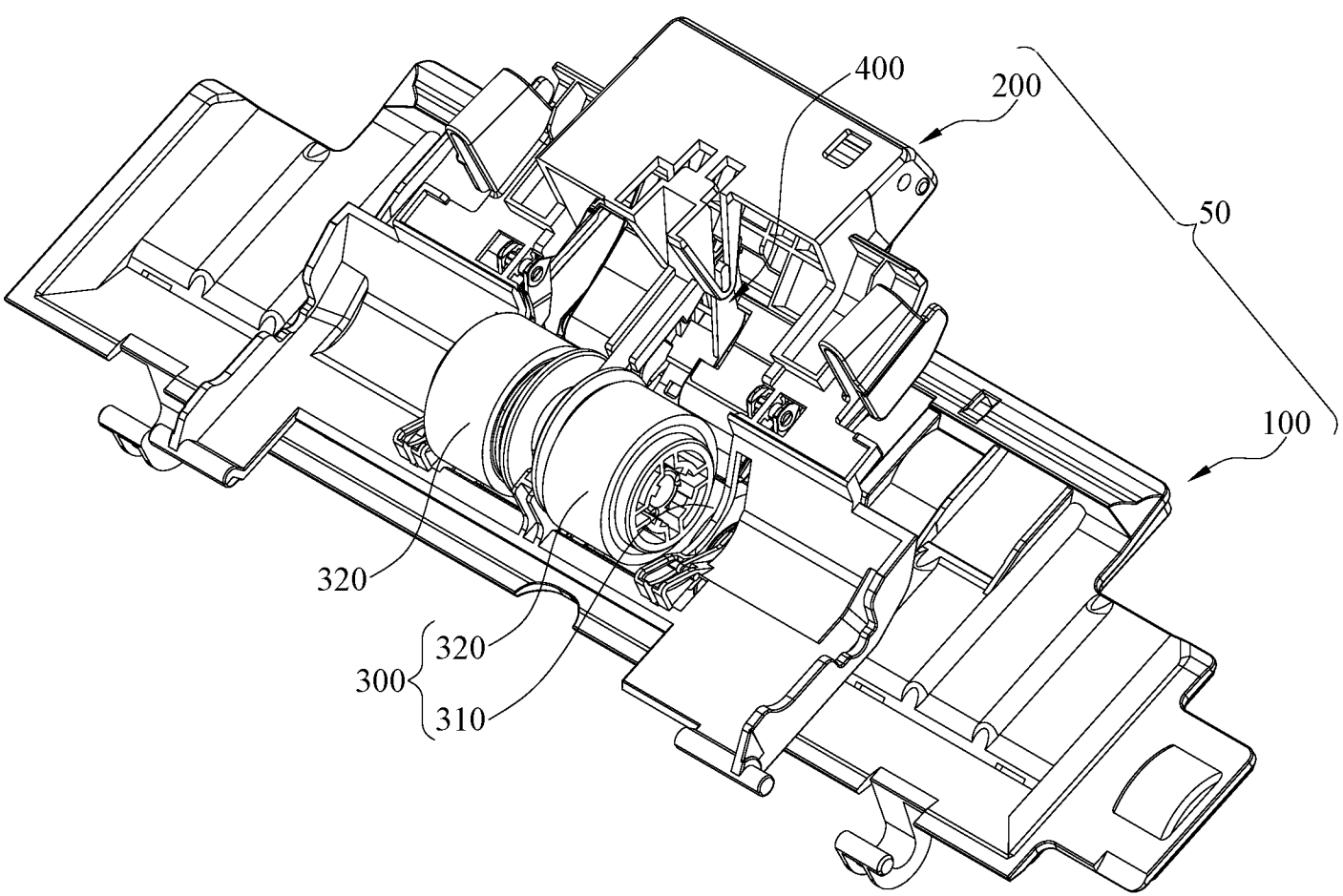
FIG. 1 is a perspective view of a feeding mechanism in accordance with one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
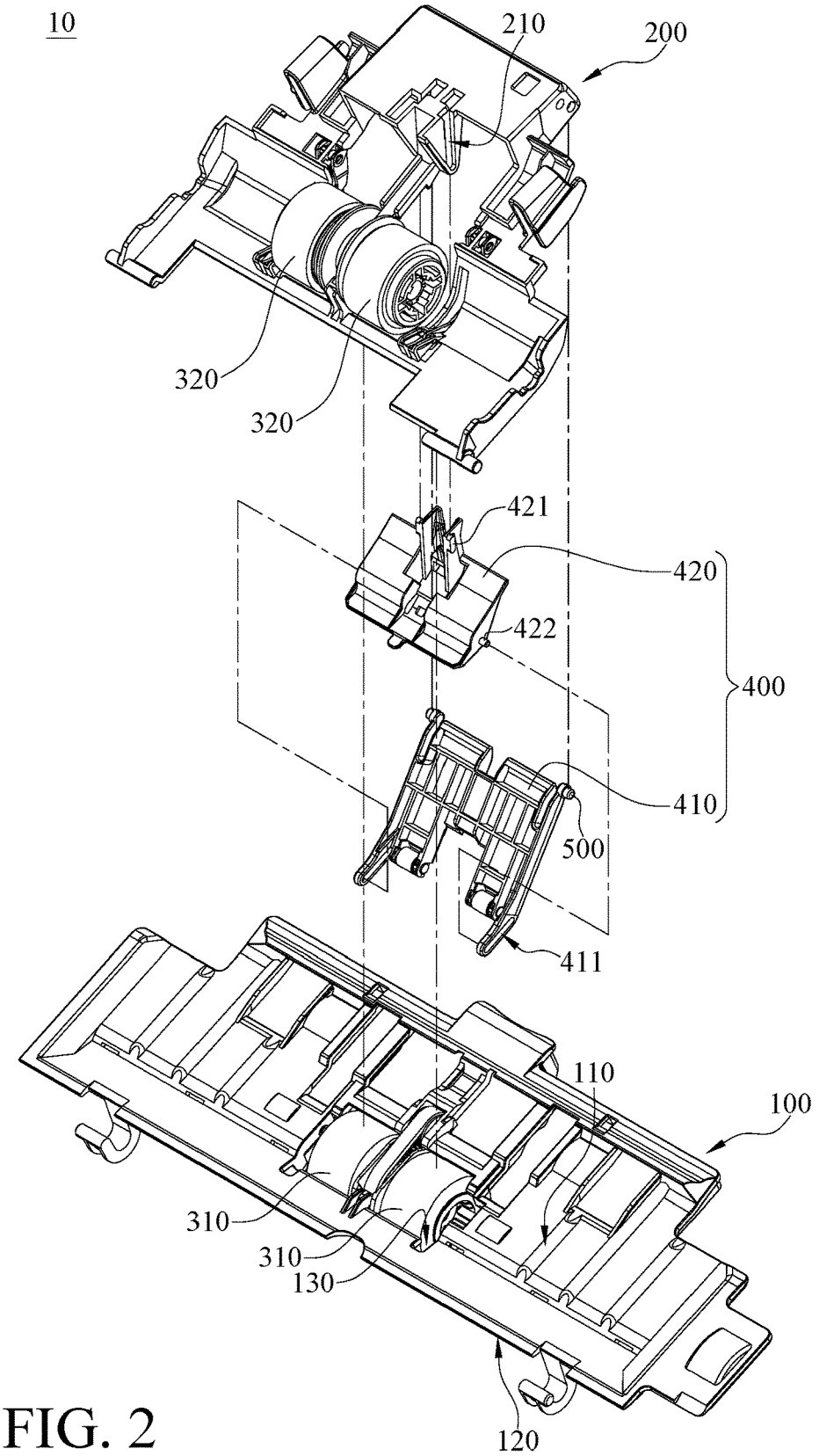
FIG. 2 is an exploded view of the feeding mechanism in FIG. 1.
Figure 3:
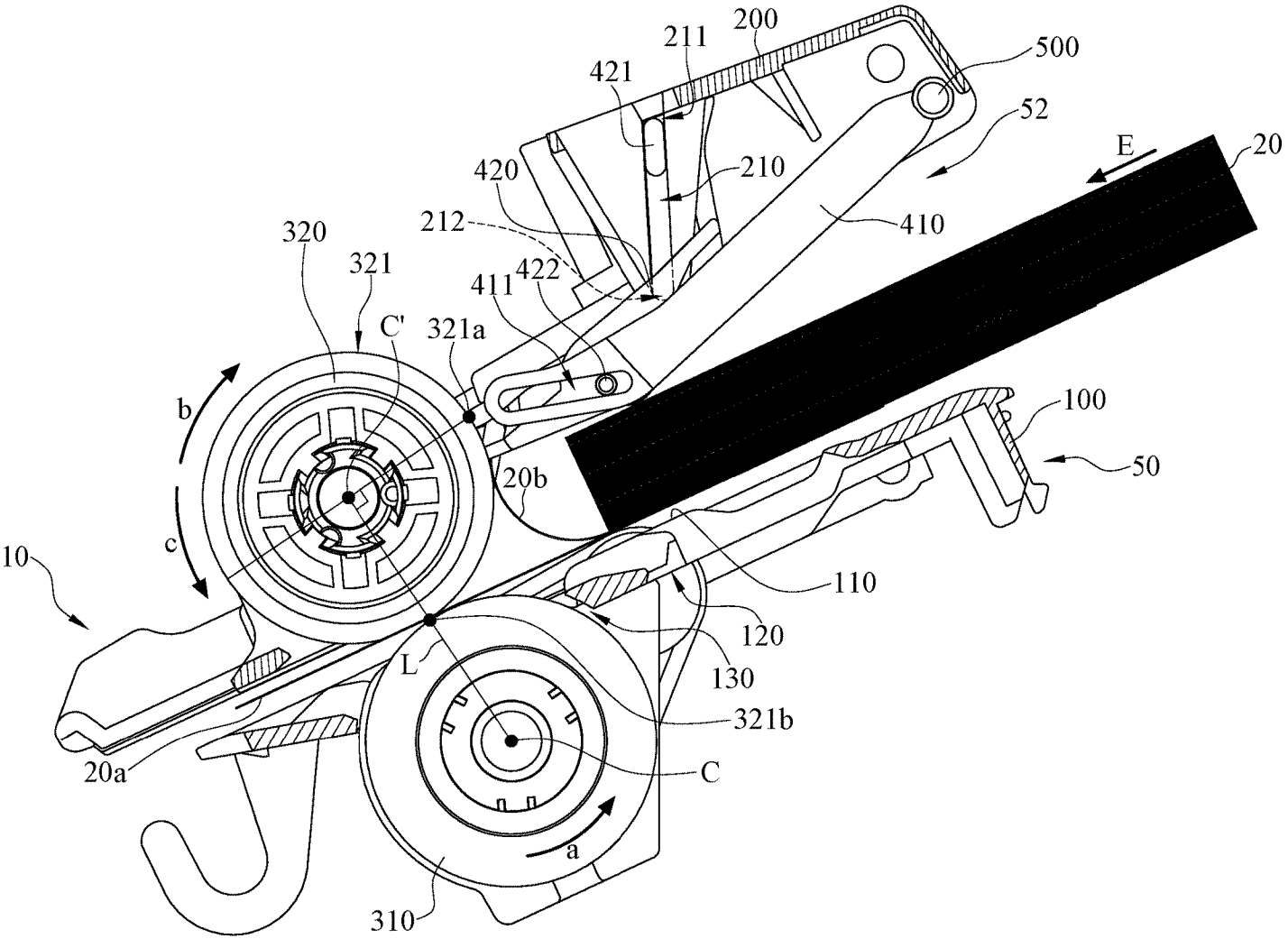
FIG. 3 is a cross-sectional view of the feeding mechanism in FIG. 1 with a flexible object placed therein.

Please refer to FIG. 1 to FIG. 3. FIG. 1 is a perspective view of a feeding mechanism in accordance with one embodiment of the disclosure. FIG. 2 is an exploded view of the feeding mechanism in FIG. 1. FIG. 3 is a cross-sectional view of the feeding mechanism in FIG. 1 with a flexible object placed therein.

In this embodiment, a feeding mechanism 10 is provided. The feeding mechanism 10 is, for example, disposed in an office machine (not shown), a scanner or a printer. The feeding mechanism 10 is configured for feeding a flexible object 20 (as shown in FIG. 3). In addition, the office machine is, for example, a machine with print, copy and scan function. The flexible object 20 includes many scanning materials, each of the scanning materials is flexible, a sheet-shaped object, and can be deformed according to a transmitting path during the transmission by a driving mechanism. Each of the scanning materials is, for example, a sheet material, a film or a paper sheet.

The feeding mechanism 10 includes a base body 50, a feeding roller assembly 300 and a linkage assembly 400.

The base body 50 includes, for example, a carrier 100 and an assembly frame 200. The assembly frame 200 has a feeding channel 52. The base body 50 is composed of the carrier 100 and the assembly frame 200, but the present disclosure is not limited thereto. In other embodiments, the base body may only be composed of a single component.

The carrier 100 has a carrying surface 110, a back surface 120 and a through hole 130. The carrying surface 110 is used for carrying the flexible object 20. The back surface 120 and the carrying surface 110 are respectively on the opposite sides of the carrier 100. The through hole 130 extends from the carrying surface 110 to the back surface 120, and is connected to the feeding channel 52.

The assembly frame 200 is located above the carrier 100. In this or other embodiments, the assembly frame 200 is disposed on a fixed housing of the office machine (not shown) so as to be located above the carrier 100, but the present disclosure is not limited thereto.

The feeding roller assembly 300 includes two feeding rollers 310 and two withdrawing rollers 320. The feeding rollers 310 are rotatably disposed on the carrier 100 and are disposed through the through hole 130. A part of each feeding roller 310 is located in the feeding channel 52. The withdrawing rollers 320 are disposed on the assembly frame 200.

Each withdrawing roller 320 has a cylindrical surface 321. The cylindrical surface 321 presses against the feeding rollers 310, such that each withdrawing roller 320 is able to be driven by the feeding rollers 310 to rotate in a rotational direction (as indicated by the arrow b) which is opposite to a rotational direction (as indicated by the arrow a) of each feeding roller 310 when the withdrawing rollers 320 are taken as passive rollers. In addition, the withdrawing roller 320 is driven by a driving member (not shown) to rotate in a rotational direction (as indicated by the arrow c) which is the same as the rotational direction (as indicated by the arrow a) of the feeding roller 310.

In this embodiment, the feeding roller assembly 300 includes two feeding rollers 310 and two withdrawing rollers 320, but the present disclosure is not limited thereto. In other embodiments, the feeding roller assembly may only include one feeding roller and one withdrawing roller.

In addition, in this embodiment, the scanning material is able to be withdrawn by the withdrawing rollers 320, but the present disclosure is not limited thereto. In other embodiments, the scanning material may be withdrawn through friction or electrostatic force.

The linkage assembly 400 includes a guiding component 410 and a pressing component 420. The guiding component 410 is pivotally coupled to the assembly frame 200 by a pivot 500. One end of the pressing component 420 is slidably disposed on the assembly frame 200, and the other end of the pressing component 420 is slidably disposed on the guiding component 410. The guiding component 410 is rotatable relative to the assembly frame 200 so as to drive the pressing component 420 to move along an extension direction of the feeding channel 52 relative to the guiding component 410.

In detail, a line of centers L connects a central axis C of the feeding roller 310 and a central axis C' of the withdrawing roller 320. The assembly frame 200 has a first groove 210. The first groove 210 has a first end 211 and a second end 212 which are opposite to each other. The first end 211 of the first groove 210 is farther away from the carrier 100 than the second end 212 of the first groove 210 is to the carrier 100, and the first end 211 of the first groove 210 is farther away from the line of centers L than the second end 212 of the first groove 210 is to the line of centers L.

The guiding component 410 has a second groove 411. During the movement of the guiding component 410, an extension line of the second groove 411 is kept not parallel to the line of centers L. In addition, the extension line of the second groove 411 and the pivot 500 are spaced apart by a distance. In detail, the extension line of the second groove 411 does not pass through a central axis of the pivot 500, but the present disclosure is not limited thereto. In other embodiments, the extension line of the second groove 411 may pass through the central axis of the pivot 500.

The pressing component 420 has a first slide block 421 and a second slide block 422. The first slide block 421 is slidably located in the first groove 210, and the second slide block 422 is slidably located in the second groove 411, such that the pressing component 420 is able to be moved relative to the withdrawing rollers 320.

Figure 4:
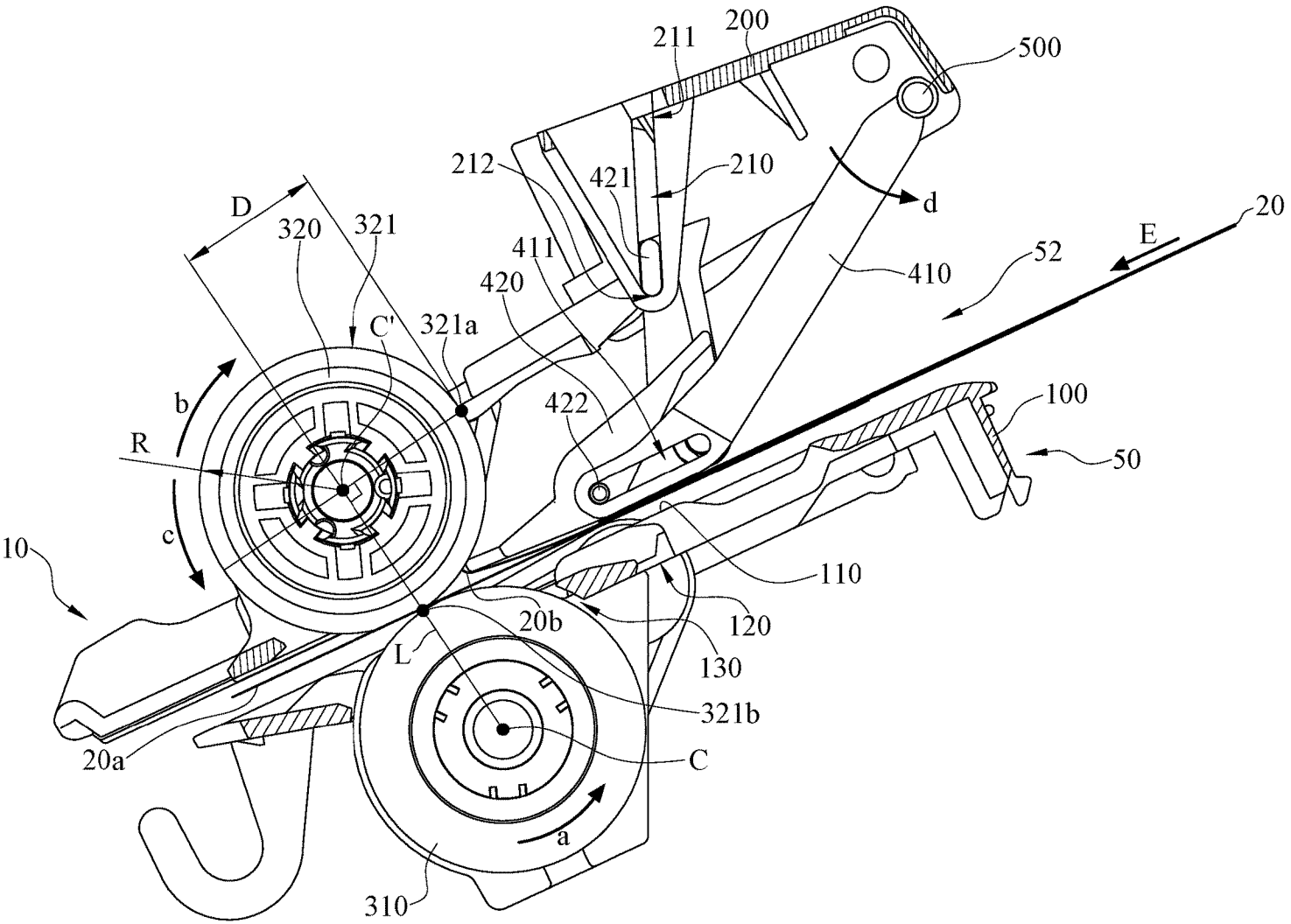
FIG. 4 is another cross-sectional view of the feeding mechanism in FIG. 1 with thinner flexible object placed therein.

Furthermore, please refer to FIG. 3 and FIG. 4. FIG. 4 is another cross-sectional view of the feeding mechanism in FIG. 1 with thinner flexible object placed therein.

In this embodiment, each cylindrical surface 321 has a first side margin 321*a* and a second side margin 321*b*. The first side margin 321*a* is on a side of the withdrawing roller 320 close to the guiding component 410, and a distance D between the first side margin 321*a* and the line of centers L is equal to a radius R of the withdrawing roller 320; that is, the first side margin 321*a* is the side margin farthest away from the line of centers L. The second side margin 321*b* is on a side of the withdrawing roller 320 close to the feeding rollers 310, and the line of centers L passes through the second side margin 321*b*.

As shown in FIG. 3, since the thickness of a pile of the scanning materials are relatively large, the guiding component 410 of the linkage assembly 400 is pushed upward by the flexible object 20 so as to drive the pressing component 420 of the linkage assembly 400 to move toward the first side margin 321*a* of the cylindrical surface 321. Moreover, with the guidance of the first groove 210 and the second groove 411, the pressing component 420 presses against or is nearly in contact with the cylindrical surfaces 321. The phrase "nearly in contact with" means that two objects are not in contact with each other but are very close to each other.

In the situation shown in FIG. 3, if the feeding mechanism 10 feeds only one scanning material 20*a*, the scanning material 20*a* is driven by the feeding rollers 310 to move forward along a predetermined transmitting path; that is, the scanning material 20*a* passes through an area between the feeding rollers 310 and the withdrawing rollers 320.

If the feeding mechanism 10 accidentally feeds two scanning materials 20*a* and 20*b* at the same time, a sensor in the feeding mechanism 10 will detect a multi-feeding of scanning materials, and then a controller in the feeding mechanism 10 will drive the withdrawing rollers 320 to rotate backwards (as indicated by the arrow c) in order to withdraw the scanning material 20*b* or curl up the scanning material 20*b*. As a result, only the scanning material 20*a* relatively close to the carrier 100 can be driven to move forward along the predetermined transmitting path and passes through the area between the feeding rollers 310 and the withdrawing rollers 320, thereby avoiding the problem of missing scan. It is noted that when the scanning material 20*b* is curled up by the withdrawing rollers 320, the scanning material 20*b* is not jamming between the withdrawing rollers 320 and the pressing component 420 since the pressing component 420 presses against or is nearly in contact with the cylindrical surfaces 321. Therefore, a scanning material jam is prevented.

Then, as shown in FIG. 4, with the thickness of the pile of the scanning materials becomes thinner, the guiding component 410 of the linkage assembly 400 rotates toward the carrier 100 along a direction of arrow d, and drives the pressing component 420 of the linkage assembly 400 to move toward the second side margins 321*b* of the cylindrical surfaces 321. In the meantime, with the guidance of the first groove 210 and the second groove 411, the pressing component 420 is relatively close to the line of centers L, such that the pressing component 420 is kept pressing against or nearly in contact with the cylindrical surfaces 321.

In the situation shown in FIG. 4, if feeding mechanism 10 feeds only one scanning material 20*a*, the scanning material 20*a* is driven to move forward along a predetermined transmitting path by the feeding rollers 310; that is, the scanning material 20*a* passes through the area between the feeding rollers 310 and the withdrawing rollers 320.

If the feeding mechanism 10 accidentally feeds two scanning materials 20*a* and 20*b* at the same time, a sensor in the feeding mechanism 10 will detect the multi-feeding of scanning materials, and then a controller in the feeding mechanism 10 will drive the withdrawing rollers 320 to rotate backwards (as indicated by the arrow c) in order to withdraw the scanning material 20*b* or curl up the scanning material 20*b*. As a result, only the scanning material 20*a* relatively close to the carrier 100 can be driven to move forward along the predetermined transmitting path and passes through the area between the feeding rollers 310 and the withdrawing rollers 320, thereby avoiding the problem of missing scan. It is noted that when the scanning material 20*b* is curled up by the withdrawing rollers 320, the scanning material 20*b* is not jamming between the withdrawing rollers 320 and the pressing component 420 since the pressing component 420 presses against or is nearly in contact with the cylindrical surfaces 321. Therefore, the scanning material jam is prevented.

According to the feeding mechanism as described above, the pressing component, which is able to be moved relative to the withdraw roller, is disposed between the rotatable guiding component and the withdrawing roller. Therefore, even though the gap between the guiding component and the withdrawing roller becomes larger when the rotatable guiding component rotates downward, the gap, however, can be reduced due to a part of the gap covered by the pressing component which is movable relative to the guiding component. Thus, when the withdrawing roller rotates backwards in order to withdraw the scanning materials, the scanning materials jamming in the gap beside the withdrawing roller can be prevented due to the guidance and covering of the guiding component and the pressing component, thereby reducing the possibility of the scanning material jam.

The embodiments were chosen and described in order to best explain the principles of the disclosure and its practical applications, to thereby enable others skilled in the art to best utilize the disclosure and various embodiments with various modifications as are suited to the particular use contemplated. It is intended that the scope of the disclosure be defined by the following claims and their equivalents.

What is claimed is:

1. A feeding mechanism, comprising:

a base body, having a feeding channel;

a feeding roller, disposed on the base body, a part of the feeding roller located in the feeding channel; and a linkage assembly, comprising a guiding component and a pressing component, the guiding component pivotally coupled to the base body, two ends of the pressing component respectively and slidably disposed on the base body and the guiding component;

wherein the guiding component is rotatable relative to the base body so as to drive the pressing component to move along an extension direction of the feeding channel relative to the guiding component.

2. The feeding mechanism according to claim 1, wherein the base body comprises a carrier and an assembly frame, the assembly frame is located above the carrier, the assembly frame and the carrier together form the feeding channel therebetween, the feeding roller is disposed on the carrier of the base body, the guiding component is pivotally coupled to the assembly frame, two ends of the pressing component are respectively and slidably disposed on the assembly frame and the guiding component.

3. The feeding mechanism according to claim 2, further comprising at least one withdrawing roller, the at least one withdrawing roller disposed on the assembly frame and having an cylindrical surface, the cylindrical surface pressing against the feeding roller, a line of centers connecting a central axis of the feeding roller and a central axis of the at least one withdrawing roller, the guiding component rotatable relative to the base body so as to drive the pressing component to move toward or away from the line of centers.

4. The feeding mechanism according to claim 3, wherein the cylindrical surface has a first side margin and a second side margin, the first side margin is on a side of the withdrawing roller close to the guiding component, and a distance between the first side margin and the line of centers is equal to a radius of the withdrawing roller, the second side margin is on a side of the withdrawing roller close to the feeding roller, and the line passes through the second side margin, the pressing component is relatively close to the line of centers when the guiding component rotates from the first side margin toward the second side margin.

5. The feeding mechanism according to claim 3, wherein the assembly frame has a first groove, one end of the first groove, which is away from the carrier, is farther away from the line of centers than another end of the first groove, which is close to the carrier, is to the line of centers, the pressing component has a first slide block, and the first slide block is slidably located in the first groove.

6. The feeding mechanism according to claim 5, wherein the guiding component has a second groove, an extension direction of the second groove is not parallel to the line of centers during the movement of the guiding component, the pressing component has a second slide block, and the second slide block is slidably located in the second groove.

7. The feeding mechanism according to claim 6, wherein the guiding component is pivotally coupled to the assembly frame by a pivot, and an extension line of the second groove and the pivot are spaced apart by a distance.

8. The feeding mechanism according to claim 3, wherein a rotational direction of the withdrawing roller is the same as or different from a rotational direction of the feeding roller.

* * * * *